US008100566B2

(12) United States Patent
Storch

(10) Patent No.: US 8,100,566 B2
(45) Date of Patent: Jan. 24, 2012

(54) LIGHT FIXTURE WITH ADJUSTABLE AND FIXABLE MOUNT

(75) Inventor: Klaus Storch, Altena-Evingsen (DE)

(73) Assignee: Willy Meyer = Sohn GmbH & Co. KG, Hemer-Ihmert (DE)

( * ) Notice: Subject to any disclaimer, the term of this patent is extended or adjusted under 35 U.S.C. 154(b) by 268 days.

(21) Appl. No.: 12/642,895

(22) Filed: Dec. 21, 2009

(65) Prior Publication Data

US 2010/0157611 A1 Jun. 24, 2010

(51) Int. Cl.
*F21V 21/00* (2006.01)

(52) U.S. Cl. ..... 362/370; 362/371; 362/432

(58) Field of Classification Search ..... 362/273, 362/287, 289, 370, 371, 372, 427, 432, 457, 362/640

See application file for complete search history.

(56) References Cited

U.S. PATENT DOCUMENTS

| | | | | |
|---|---|---|---|---|
| 5,788,363 | A * | 8/1998 | Kamaya et al. | 362/370 |
| 6,953,270 | B1 * | 10/2005 | Richardson | 362/371 |
| 7,934,860 | B2 * | 5/2011 | Tsao | 362/287 |
| 2003/0151923 | A1 * | 8/2003 | Wu | 362/370 |

* cited by examiner

*Primary Examiner* — Y My Quach Lee
(74) *Attorney, Agent, or Firm* — Andrew Wilford

(57) ABSTRACT

A light fixture has a bracket adapted to be fixed to a wall or ceiling surface and having a leg formed with a leg hole, and a bolt fixed in the fixture housing and projecting therefrom along an axis through the leg hole. A ring engageable over an outer profiled end of the bolt can fit complementarily therewith. An annular disk fits over the ring, has a back face turned toward and engageable around the ring with the leg, and is formed with a radially extending threaded bore holding a radial screw engageable radially inward with the ring to rotationally lock the disk on the ring. The disk and leg fit are locked together so they cannot relatively rotate. An axial screw engaged through the disk and ring with the bolt engages axially inward with the disk to press the disk against the leg and the leg against the housing.

10 Claims, 3 Drawing Sheets

LIGHT FIXTURE WITH ADJUSTABLE AND FIXABLE MOUNT

FIELD OF THE INVENTION

The present invention relates to light fixture. More particularly this invention concerns a light fixture with a mount that allows the position of the fixture to be adjusted and then fixed.

BACKGROUND OF THE INVENTION

The invention relates to an electric light fixture with a mounting pedestal or bracket for stationary fixing, consisting of a fixture housing and a mounting pedestal or bracket on which the fixture housing is releasably fixed and which can be fixed in a stationary manner. The fixture housing or a leg projecting from the fixture housing has a wall with a bolt projecting therefrom and having an outer end projecting beyond the wall and passing through a first hole of the mounting bracket. A fixing assembly is releasably attached to the outer end of the bolt projecting from the first hole of the mounting bracket.

Such light fixtures are used for example to illuminate building façades. In this case, a plurality of such light fixtures are fixed in a stationary manner by respective mounting brackets. The light fixtures can be installed in a specific orientation in order to achieve the desired uniform illumination of a façade. It is relatively difficult and complicated to orient the light fixtures since, in order to illuminate a façade for example, a precise orientation and angular position of the light fixtures must be set. On first installation, this is initially not a problem since the installers carrying out the installation are trained people who are able to perform the correct orientation. A problem arises when the lamp or light source of the electric light fixture in question has to be replaced. Usually the light fixture is then detached from the mounting bracket, so that the installer can replace the light source. The light fixture is then reattached to the mounting bracket. However, when doing so, the installer does not have any assistance in orienting the light fixture relative to the mounting bracket, and therefore he can perform only a rough orientation which does not correspond to the original orientation done by an expert.

OBJECTS OF THE INVENTION

It is therefore an object of the present invention to provide an improved light fixture with adjustable and fixable mount.

Another object is the provision of such an improved light fixture with adjustable and fixable mount that overcomes the above-given disadvantages, in particular with which it is possible to remove the light fixture from the mounting bracket to replace the light source for example, but nevertheless the originally set orientation of the light fixture is retained after reinstallation.

SUMMARY OF THE INVENTION

A light fixture has according to the invention a housing having an end face, a bracket adapted to be fixed to a is wall or ceiling surface and having a leg formed with a leg hole, and a bolt fixed in the housing and projecting therefrom along an axis through the leg hole. A ring is engageable over an outer profiled end of the bolt and can fit complementarily therewith so as to be rotationally fixed on the bolt with the leg between the ring and the housing. An annular disk fits over the ring, has a back face turned toward and engageable around the ring with the leg, and is formed with a radially extending threaded bore holding a radial screw engageable radially inward with the ring to rotationally lock the disk on the ring. Interengaging eccentric formations on the back face of the disk and on the leg engage axially together to rotationally lock the disk on the leg. An axial screw engaged through the disk and ring with the bolt has a head engageable axially inward with the disk to press the back face of the disk against the leg and the leg against the housing end face and engage the disk formations with the leg formations.

In this arrangement, when first mounting the light fixture on the mounting bracket, the mounting bracket is placed onto the fixture housing so that the bolt projecting outward from the fixture housing is seated in the corresponding first hole of the mounting bracket and passes through it. The ring is then placed on the end of the bolt projecting from the mounting bracket. This disk, like the end of the bolt, has a shape differing from circular, so that it can not rotate relative to the bolt when fitted therewith. In this way, rotation of the housing is transmitted to the disk. The cover disk with its stepped bore is then placed over the disk so that the cover disk engages over the ring with the inner large-diameter part of the stepped bore. For preliminary fixing purposes, the cover disk can be fixed loosely to the bolt by means of the cap screw. The correct position of the light fixture relative to the mounting bracket then is set. As soon as the correct position has been set, the threaded pin is tightened so that the cover disk is locked on and cannot rotate relative to the ring over which it engages, this ring being in turn rotationally locked to the fixture housing. Before the threaded pin is tightened, the cover disk is placed over the ring such that the projection(s) or pin(s) on the cover disk engage in the corresponding hole(s) of the mounting bracket. The cap screw is then finally tightened, so that the connection is solidly fixed.

When it is necessary to replace the light source and thus to detach the light fixture from the mounting bracket, all that is required is to undo the axial cap screw. It is then possible to remove the complete unit consisting of the cover disk and the ring held nonrotatably thereon, together with the pins or projections, so that the light fixture can then be removed from the mounting bracket or rotated about the bolt to which the fixture housing is fixed.

Once the light source has been replaced or the other installation work has been performed, the light fixture can be fixed back in the original position relative to the mounting bracket by placing the ring together with the cover disk and pins or projections over the projecting end of the bolt. Due to the complementary noncircular or profiled shapes of the bolt and of the hole in the disk, just one orientation of the parts relative to one another is possible. When the corresponding projections or pins engage in the hole of the mounting bracket, the originally selected mounting position is again reached and is secured simply by tightening the cap screw. Following replacement of the light source or other such work, therefore, the originally set position of the light fixture relative to the mounting bracket is restored so that the desired orientation of the light fixture relative to the façade or the like in the original state is ensured.

Preferably the fixture housing has two parallel surfaces, and the mounting bracket is U-shaped and receives the fixture housing between its legs. Two opposite end faces of the housing each have a bolt, the bolts being arranged coaxial to one another. At least one bolt is equipped with a fixing arrangement comprised of a disk, a ring, and radial and axial screws.

Here, the fixture housing is placed between the legs of the U-shaped mounting bracket, and the light fixture accordingly has the bolts on the two surfaces corresponding to the legs of the bracket, and the corresponding fixing elements, namely the ring, the disk, the projections or pins and the radial set screw and also the axial cap screw, are arranged on the bolts. In some circumstances, it may be sufficient if just one leg of the mounting bracket is fixed and attached in this manner while the other leg is simply passed through by a bolt onto which a nut or the like is screwed for fixing purposes. The orientation of the light fixture would in this case be achieved by orienting the one mounting element configured according to the invention.

In principle, the bolt can be fixed to the housing in any desired manner. Preferably, however, the bolt has a threaded inner end or shaft by means of which it is screwed in a self-locking manner into a matching threaded bore of the fixture housing or of the leg projecting therefrom. For self-locking, an anti-loosening means may be provided, for example a coating.

For easy rotation of the fixture housing relative to the mounting bracket in a not yet finally fixed position, the bolt has a circular cross-section in the region on which the first hole of the mounting bracket is mounted.

One particularly preferred embodiment is that the end of the bolt projecting from the first hole of the mounting bracket has in cross-section a polygonal or oval profile or is provided with a peripheral axial toothing, as a result of which the first shape is formed. The central hole of the ring has an identical polygonal, oval or toothed inner surface in order to form the second cross-sectional shape.

In particular, when the free end of the bolt is equipped with peripheral teeth and also the central hole of the ring has corresponding teeth on the inner periphery a very secure arrangement of the parts relative to one another in the final state is ensured without there being any undesired movement play in the direction of rotation.

Preferably, it is moreover provided that the ring has a circumferential groove on the outside, in which the tip of the threaded pin engages. As a result, fixing upon tightening of the grub screw is improved. In addition when the radial set screw is a little loose, it still retains the parts axially together while permitting relative rotation.

In order to achieve a secure hold of the light fixture on the mounting bracket, the cover disk has one, two or three projections or pins on its back face directed toward the mounting bracket. These projections or pins are at an angular spacing of 120° or 180° from one another, and the mounting surface of the mounting bracket has an equal number of identically oriented second holes in which the projections or pins engage in the desired mounted position. Although such an embodiment theoretically allows an arrangement differing from the original angular orientation when the light fixture is reinstalled on the mounting bracket, nevertheless this is possible only in different angular degrees of 120° or 180°, and therefore the user immediately recognizes that the light fixture is being mounted incorrectly. Accordingly, incorrect mounting is in principle is ruled out.

Preferably the head of the cap screw is countersunk into the cover disk in the desired mounted position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
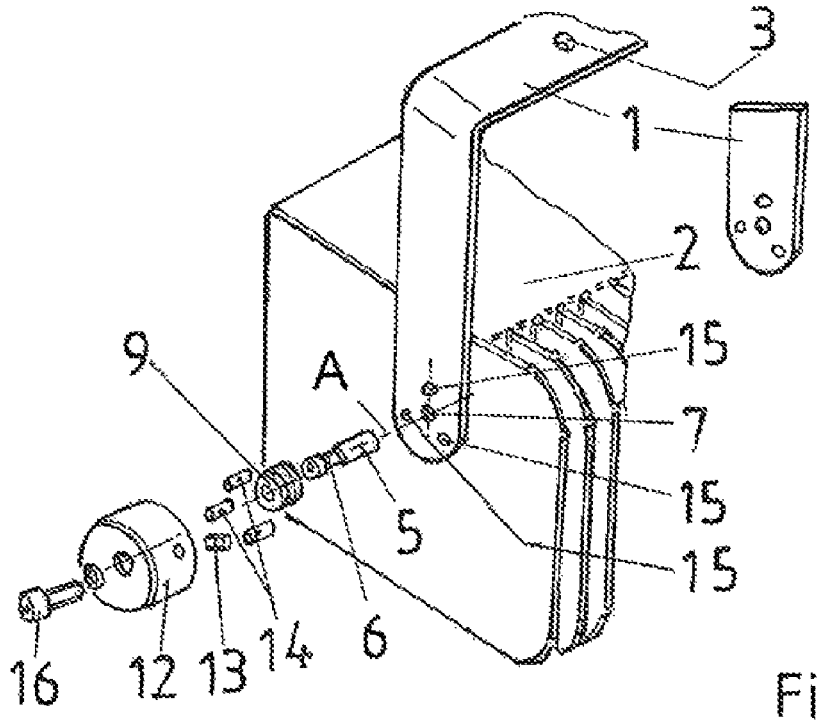
FIG. 1 is a partly broken-away and exploded view of a mount with a light fixture according to the invention.
Figure 2:
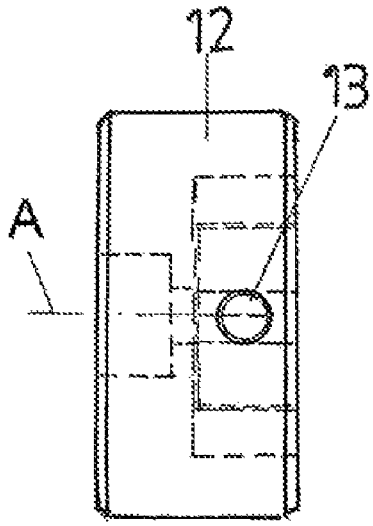
FIGS. 2, 3, and 4 are side, front, and back views of a part of the invention.
Figure 3:
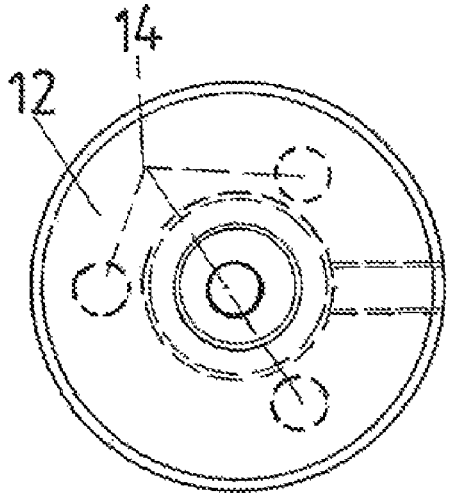
Figure 4:
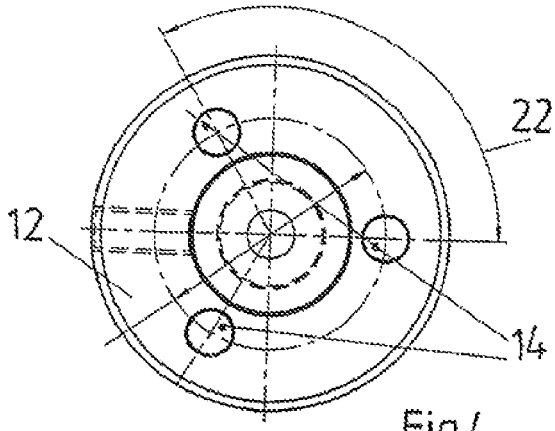
Figure 5:
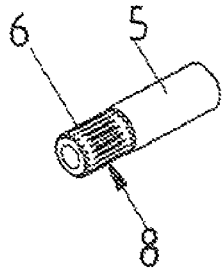
FIG. 5 is a perspective view of another part of the invention.
Figure 6:
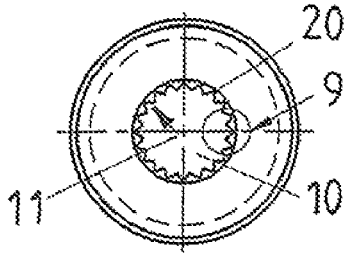
FIG. 6 is a front view of yet another part of the instant invention in somewhat enlarged scale.
Figure 7:
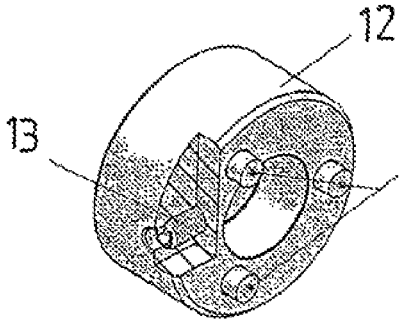
FIG. 7 is a perspective view of the part shown in FIGS. 2-4.
Figure 8:
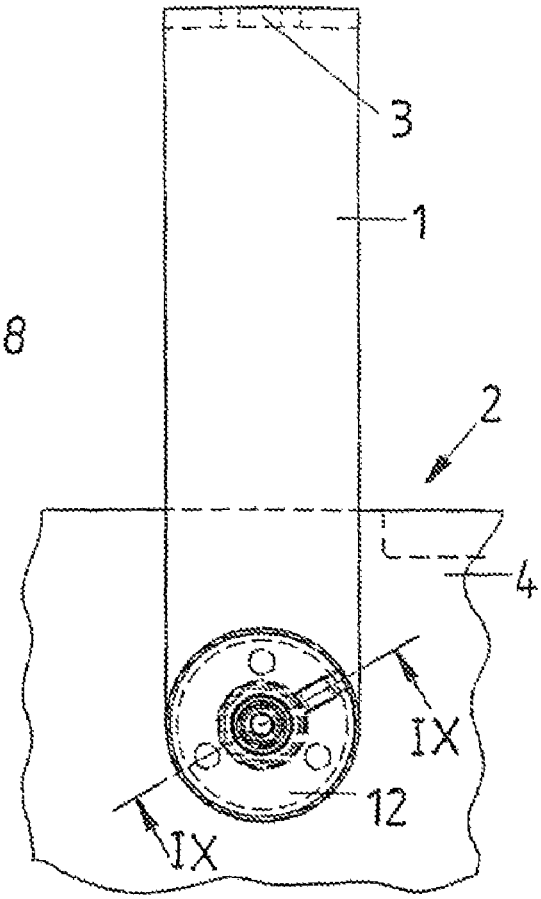
FIG. 8 is a front view of the assembled mount and light fixture.

As seen in FIG. 1 an electric light fixture has a squared-off U-shaped mounting bracket 1 and a fixture housing 2 releasably fixed to the mounting bracket 1 in a manner that will be described in more detail below. The mounting bracket 1 is usually fixed in a stationary manner on a corresponding support. To this end, the mounting bracket 1 has mounting holes 3 for fasteners. The housing 2 has a end walls 4 (only one shown) and a bolt 5 projecting therefrom along an axis A from each end wall 4. The bolts 5 each have an outer end 6 projecting beyond the respective wall 4 and passing through a respective first hole 7 of a respective leg of the mounting bracket 1.

A fixing assembly is releasably attached to the end 6 of the bolt 5 projecting from the first hole 7. Here, the end 6 of the bolt 5 projecting from the first hole 7 of the mounting bracket 1 has in cross-section an external formation 8 imparting to the end a noncylindrical shape and onto which a ring 9 is fitted axially. The ring 9 has a central hole 10 with an internal formation 11 which is complementary to the formation 8. There the formation 8 is axially extending and radially inwardly projecting teeth or ridges 19 and the formation 11 is inwardly open complementary axially extending grooves 20.

Fitted over the ring 9 in the desired mounted position is a cover disk 12 with a stepped bore that engages over the ring 9. The cover disk 12 in turn is fitted with a radially extending threaded pin or screw 13 that is accessible from outside. This pin 13 extends radially and can be actuated from outside at its radial outer end. Its inner end can project radially inward past the inner periphery of the cover disk 12. The cover disk 12 has at least one eccentric and axially rearwardly projecting pin 14 on its back side facing toward the mounting bracket 1, here three of them radially equispaced from and angularly equispaced by an angle 22 of 120° about the axis A. These pins 14 engage in respective second holes 15 of the mounting surface of the mounting bracket 1 in the desired mounted position. Finally, the cover disk 12 is secured by means of a cap screw 16 that passes through the cover disk 12 and the ring 9 and that is threaded into an axial bore of the bolt 5, so that the assembly consisting of the parts 9, 12 and 14 is clamped against the front face of the mounting bracket 1. The bolt 5 has a threaded rear end seated in a matching threaded bore 18 of the housing 2.

Figure 9:
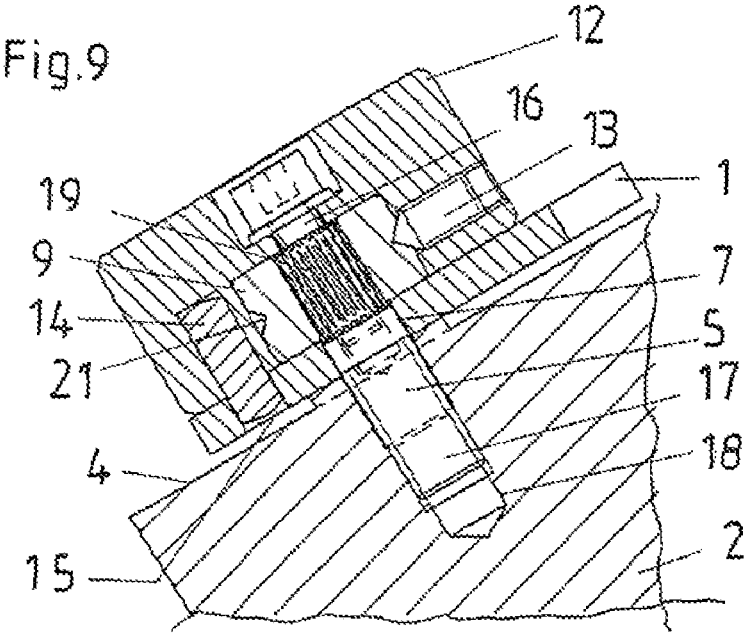
FIG. 9 is a section taken along line IX-IX in FIG. 8.

In the illustrated embodiment, the housing 2 is parallelepipedal and the mounting bracket 1 is U-shaped. The housing 2 fits between the legs of the bracket 1 so that another such fixing arrangement like that shown in FIG. 1 is provided on the other side in the region of the other unillustrated leg of the bracket 1. As can be seen in particular from FIG. 9, the ring 9 has a circumferential notched groove 21, in which the tip of the threaded pivot pin 13 engages in the screwed-in state. As also shown in FIG. 9, the head of the cap screw 16 is countersunk into the cover disk 12 in the desired mounted position.

The fixture whose housing 2 is shown is mounted on the bracket 1 as follows, where the discussion only relates to action taken on one leg of the bracket 1 with the understanding that the steps are carried out on both legs.

The housing 2 is oriented relative to the mounting bracket 1 in such a way that the hole 18 in the housing 2 intended to receive the bolt 5 is aligned with the hole 7 of the mounting bracket 1. The bolt 5 can then be screwed through the hole 7 into the hole 18 of the housing 2.

The ring 9 is then fitted over the profiled end 6 of the bolt 5. Because of the interfitting formations 8 and 11 these two parts 5 and 9 cannot rotate relative to each other, so that the ring 9 is rotationally fixed to the housing 2 but can rotate about the axis A in the bracket 1. The cover disk 12 is then fitted over the ring 9 so that the pins 14 of the cover disk 12 engage in the second holes 15 of the mounting bracket 1, which action couples the disk 12 angularly of the axis A to the bracket 1. In this position the housing 2 with the disk 12 can pivot about the axis A relative to the bracket 1 and the wall or ceiling 4 on which it is mounted. The housing 2 is rotated about the axis A relative to the mounting bracket 1 until the desired position is reached with the light from the lamp or other light source in the housing 2 falling where it is wanted.

The threaded screw 13 is then screwed in to bear radially inward on the ring 9 in the groove 21, so that the relative position of the ring 9 relative to the cover disk 12 is securely set and can no longer be varied. This rotationally locks the housing 2 to the bracket 1. The cap screw 16 is then fitted through the disk 12 and ring 9 into the threaded axially outwardly open hole in the pivot pin 5. This screw 16 is tightened to further lock the light fixture in the set position.

When the housing is subsequently to be dismounted, for instance to clean or service it or change the lamp, the cap screw 16 is loosened and the mounting unit consisting of the parts 12 and 9 is removed or else is loosened and displaced until the pins 14 no longer engage in the corresponding holes 15. The housing 2 is then pivotable in the mounting bracket 1. Spreading of the legs of the bracket 1 can aid this action. After the necessary actions have been completed, the housing 2 is once more preadjusted relative to the mounting bracket 1 and the mounting unit consisting of the ring 9, the cover disk 12 and the pins 14 are moved into the correct position so that they engage in the second holes 15. The cap screw 16 is then tightened so that the connection is finally established and secured.

In the event of removal carried out in this way, it is easily possible for the service person to reset the originally set relative angle of the housing 2 relative to the mounting bracket 1, since the mounting unit 9, 12, 14 allows just one desired mounting position that can reasonably be assumed. Thus the fixture can be accurately positioned once, and subsequent repair or service operations do not require it to be reset, although it is easy to reset the fixture later by action on the screws 13 that do not need to be touched to uninstall it.

Subsequent adjustments to set the light exit angle of the electric light fixture relative to the façade lighting or the like are neither necessary nor possible.

The invention is not limited to the example of embodiment but rather can be varied in many ways within the scope of the disclosure.

All new individual features and combinations of features disclosed in the description and/or drawing are regarded as essential to the invention

I claim:

1. A light fixture comprising:

a light-fixture housing having an end face;

a bracket adapted to be fixed to a wall or ceiling surface and having a leg formed with a leg hole;

a bolt fixed in the housing and projecting therefrom along an axis through the leg hole, the bolt having an outer profiled end;

a ring engageable over the profiled end and fittable complementarily therewith so as to be rotationally fixed on the bolt with the leg between the ring and the housing;

an annular disk fittable over the ring, having a back face turned toward and engageable around the ring with the leg, and formed with a radially extending threaded bore;

a radial screw engaged in the bore of the disk and engageable radially inward with the ring to rotationally lock the disk on the ring;

interengaging eccentric formations on the back face of the disk and on the leg engageable axially together to rotationally lock the disk on the leg; and an axial screw engageable through the disk and ring with the bolt and having a head engageable axially inward with the disk to press the back face of the disk against the leg and the leg against the housing end face and engage the disk formations with the leg formations.

2. The light fixture defined in claim 1 wherein the fixture has two such end faces and the bracket is U-shaped and has two such legs each juxtaposed with a respective one of the end faces, a respective such bolt, ring, disk, radial screw, and axial screw, the bolts being coaxial.

3. The light fixture defined in claim 1 wherein the housing has on the end face an outwardly open threaded bore and the bolt has a threaded inner end seated in the bore of the housing.

4. The light fixture defined in claim 3 wherein the bolt has between the inner end seated in the housing and the profiled outer end a region of cylindrical shape engaging the leg.

5. The light fixture defined in claim 1 wherein the bolt has at least one radially projecting and axially extending ridge and an inner periphery of the ring has at least one complementary radially open and axially extending groove.

6. The light fixture defined in claim 1 wherein the ring is formed with a circumferential and radially outwardly open groove in which an inner end of the radial screw is engageable.

7. The light fixture defined in claim 1 wherein one of the formations is at least one eccentric pin offset from the axis but extending parallel thereto and the other of the formations is an eccentric hole offset from the axis and complementary to the pin.

8. The light fixture defined in claim 7 wherein there are a plurality of such eccentric pins and eccentric holes radially equispaced from and angularly equispaced about the axis.

9. The light fixture defined in claim 1 wherein the head of the axial screw bears axially toward the end face on the disk and the disk is formed with a stepped bore having an outer portion in which the head is recessed and an inner portion engaged around the ring.

10. The light fixture defined in claim 1 wherein the ring has a cylindrical outer surface centered on the axis and the annular disk has a cylindrical inner surface centered on the axis and radially closely juxtaposed with the ring outer surface.

* * * * *